US010184414B2

(12) United States Patent
Laviola

(10) Patent No.: US 10,184,414 B2
(45) Date of Patent: Jan. 22, 2019

(54) SYSTEM AND METHOD FOR EVALUATING VEHICLE FUEL INJECTION SYSTEM

(71) Applicant: GM GLOBAL TECHNOLOGY OPERATIONS LLC, Detroit, MI (US)

(72) Inventor: Francesco Laviola, Turin (IT)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 15/632,517

(22) Filed: Jun. 26, 2017

(65) Prior Publication Data

US 2018/0372014 A1 Dec. 27, 2018

(51) Int. Cl.

| | |
|---|---|
| ***F02D 41/24*** | (2006.01) |
| ***F02D 41/18*** | (2006.01) |
| ***F02D 41/04*** | (2006.01) |
| ***F02D 41/20*** | (2006.01) |

(52) U.S. Cl.

CPC ..... *F02D 41/182* (2013.01); *F02D 41/04* (2013.01); *F02D 41/2096* (2013.01); *F02D 41/24* (2013.01)

(58) Field of Classification Search

CPC .... F02D 41/182; F02D 41/04; F02D 41/2096; F02D 41/24

USPC ..... 123/478; 701/103

See application file for complete search history.

(56) References Cited

U.S. PATENT DOCUMENTS

| | | | | |
|---|---|---|---|---|
| 6,520,167 | B1 * | 2/2003 | Kanno | F02B 61/045 123/480 |
| 6,879,903 | B2 * | 4/2005 | Jaliwala | F02D 41/2441 123/478 |
| 8,897,996 | B2 | 11/2014 | Massaro | |
| 2015/0112576 | A1 * | 4/2015 | Watanabe | F02D 41/1401 701/104 |

* cited by examiner

*Primary Examiner* — Mahmoud Gimie
(74) *Attorney, Agent, or Firm* — Lorenz & Kopf, LLP

(57) ABSTRACT

A method for analyzing a fuel injection system includes generating injection commands, including attenuating a predetermined fuel request schedule for a different one of the plurality of injectors in a plurality of test cycles. Fuel is injected according to the injection commands to complete the plurality of test cycles. The processor generates pump commands for the pump to maintain a substantially constant pressure of the common rail during the test cycles. First command data are stored for the plurality of test cycles corresponding to the injection commands sent during the test cycles. Second command data are stored for the test cycles corresponding to the pump commands sent during the test cycles. The processor processes the first command data and the second command data to determine flow characteristics of the plurality of fuel injectors.

18 Claims, 2 Drawing Sheets

SYSTEM AND METHOD FOR EVALUATING VEHICLE FUEL INJECTION SYSTEM

TECHNICAL FIELD

The present disclosure pertains to fuel injectors of a vehicle engine and, more particularly, pertains to a system and method for evaluating a vehicle fuel injection system.

BACKGROUND

An internal combustion engine conventionally includes an engine block with at least one cylinder. Each cylinder accommodates a piston, which is connected to a crankshaft via a connecting rod and, in conjunction with a cylinder head, defines a combustion chamber. A mixture of air and fuel is introduced into the combustion chamber and ignited in cyclical manner, thereby producing rapidly expanding gases that drive linear movements of the piston, which in turn are converted into rotation of the crankshaft by the connecting rod.

Preferably, the fuel injectors are controlled to inject a predetermined amount of fuel per stroke. As such, a diagnostic tool for analyzing whether the fuel injectors perform as intended would be desirable. Other objects, desirable features and characteristics will become apparent from the subsequent summary and detailed description, and the appended claims, taken in conjunction with the accompanying drawings and this background.

SUMMARY

A method is provided for analyzing a fuel injection system having a plurality of fuel injectors fluidly connected to a common rail. The fuel injection system includes a pump configured to pump fuel to the common rail. The method includes generating, by a processor, injection commands for the plurality of fuel injectors for a plurality of test cycles according to a predetermined fuel request schedule, including generating injection commands that sequentially attenuate the predetermined fuel request schedule for a different one of the plurality of injectors in the plurality of test cycles. The method also includes injecting fuel, with the injectors, according to the injection commands to complete the plurality of test cycles. Furthermore, the method includes generating, by the processor, pump commands for the pump to maintain a substantially constant pressure of the common rail during the plurality of test cycles. Additionally, the method includes storing, in a memory element, first command data for the plurality of test cycles, the first command data corresponding to the injection commands sent during the plurality of test cycles. Also, the method includes storing, in the memory element, second command data for the plurality of test cycles, the second command data corresponding to the pump commands sent during the plurality of test cycles. The method further includes receiving, by the processor from the memory element, the first command data and the second command data. Additionally, the method includes processing the first command data and the second command data to determine flow characteristics of at least one of the plurality of fuel injectors.

Furthermore, an injection system for an engine of a vehicle is provided. The injection system includes a plurality of combustion chambers. The injection system includes a common rail and a plurality of fuel injectors fluidly connected to the common rail and configured to inject fuel into a respective one of the plurality of combustion chambers.

The injection system further includes a fuel pump configured to pump fuel to the common rail and a control system in communication with a memory element. The control system is configured to generate injection commands for the plurality of fuel injectors for a plurality of test cycles according to a predetermined fuel request schedule, including generating injection commands that sequentially attenuate the predetermined fuel request schedule for a different one of the plurality of injectors in the plurality of test cycles. The control system is also configured to generate pump commands for the pump to maintain a substantially constant pressure of the common rail during the plurality of test cycles. Moreover, the control system is configured to store, in the memory element, first command data for the plurality of test cycles, the first command data corresponding to the injection commands sent during the plurality of test cycles. Also, the control system is configured to store, in the memory element, second command data for the plurality of test cycles, the second command data corresponding to the pump commands sent during the plurality of test cycles. Furthermore, the control system is configured to receive, from the memory element, the first command data and the second command data. Additionally, the control system is configured to process the first command data and the second command data to determine flow characteristics of at least one of the plurality of fuel injectors.

In addition, a method is provided for analyzing a fuel injection system having a plurality of fuel injectors fluidly connected to a common rail. The fuel injection system includes a pump configured to pump fuel to the common rail. The method includes generating, by a processor, injection commands for the plurality of fuel injectors for a plurality of test cycles according to a predetermined fuel request schedule, including generating injection commands that sequentially disable a different one of the plurality of injectors in the plurality of test cycles. Furthermore, the method includes injecting fuel, with the injectors, according to the injection commands to complete the plurality of test cycles. Also, the method includes generating, by the processor, pump commands for the pump to maintain a substantially constant pressure of the common rail during the plurality of test cycles according to a feedback signal sent from a rail pressure sensor. Additionally, the method includes storing, in a memory element, first command data for the plurality of test cycles, the first command data corresponding to the injection commands sent during the plurality of test cycles. The method further includes storing, in the memory element, second command data for the plurality of test cycles, the second command data corresponding to the pump commands sent during the plurality of test cycles, the second command data having associated pump flow amounts for the plurality of test cycles. Moreover, the method includes receiving, by the processor from the memory element, the first command data and the second command data. The method additionally includes processing the first command data and the second command data to determine flow characteristics of a first injector of the plurality of fuel injectors, including estimating the flow characteristic, F, for the first injector according to:

$$F = \frac{T - (C-2)T'}{C-1}$$

wherein T is a sum total of pump flow amounts commanded during the plurality of test cycles in which the first injector is enabled; wherein C is the total number of combustion chambers; and wherein T' is the pump flow amount commanded during the plurality of test cycles in which the first injector is disabled.

BRIEF DESCRIPTION OF THE DRAWINGS

The present disclosure will hereinafter be described in conjunction with the following drawing figures, wherein like numerals denote like elements.

DETAILED DESCRIPTION

Figure 1:
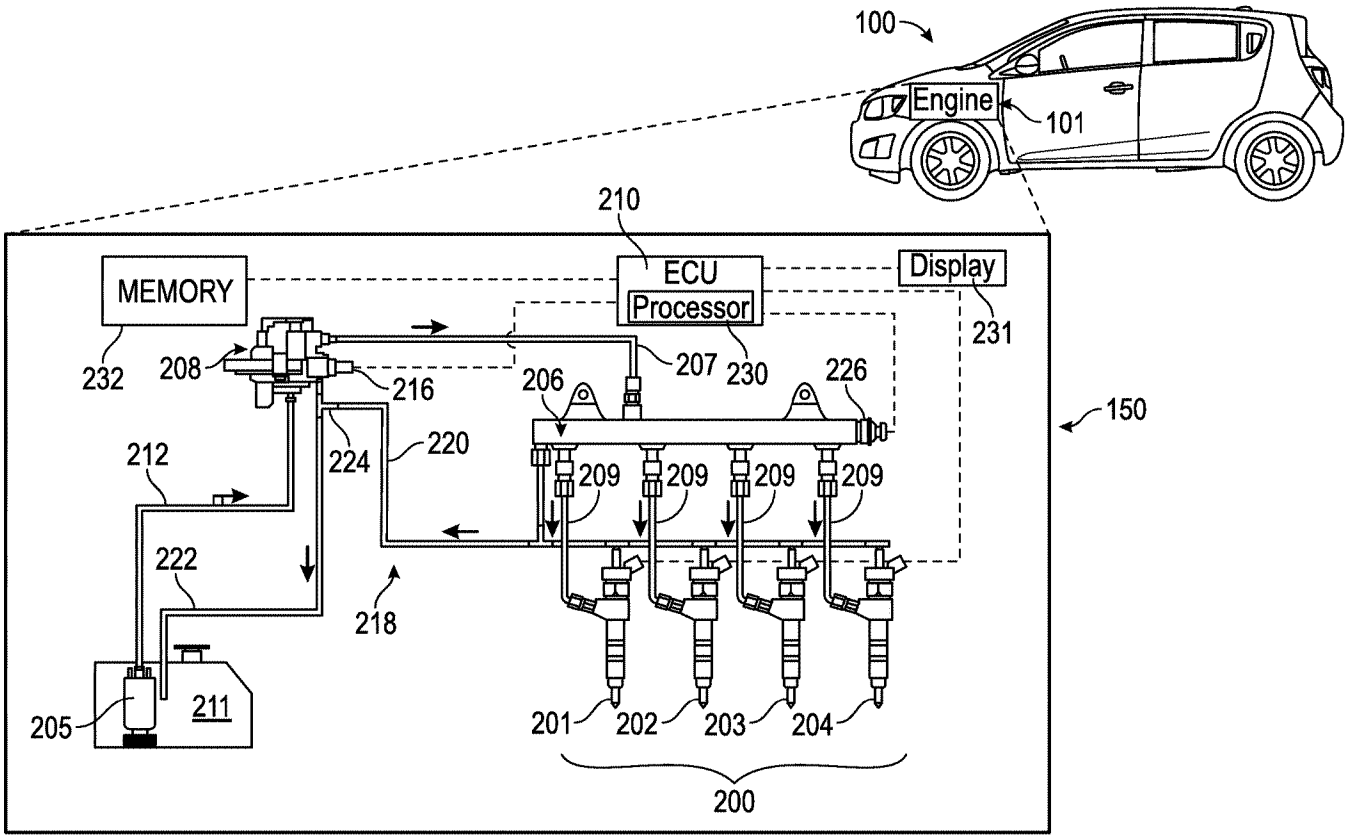
FIG. 1 is a schematic view of a fuel injection system of an engine according to example embodiments of the present disclosure.

The following detailed description is merely exemplary in nature and is not intended to limit the scope of the present disclosure or the application and uses of the present disclosure. Furthermore, there is no intention to be bound by any theory presented in the preceding background or the following detailed description.

Those of skill in the art will appreciate that the various illustrative logical blocks, modules, circuits, and algorithm steps described in connection with the embodiments disclosed herein may be implemented as electronic hardware, computer software, or combinations of both. Some of the embodiments and implementations are described above in terms of functional and/or logical block components (or modules) and various processing steps. However, it should be appreciated that such block components (or modules) may be realized by any number of hardware, software, and/or firmware components configured to perform the specified functions. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention. For example, an embodiment of a system or a component may employ various integrated circuit components, e.g., memory elements, digital signal processing elements, logic elements, look-up tables, or the like, which may carry out a variety of functions under the control of one or more microprocessors or other control devices. In addition, those skilled in the art will appreciate that embodiments described herein are merely exemplary implementations The various illustrative logical blocks, modules, and circuits described in connection with the embodiments disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. The word "exemplary" is used exclusively herein to mean "serving as an example, instance, or illustration." Any embodiment described herein as "exemplary" is not necessarily to be construed as preferred or advantageous over other embodiments.

The steps of a method or algorithm described in connection with the embodiments disclosed herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal In this document, relational terms such as first and second, and the like may be used solely to distinguish one entity or action from another entity or action without necessarily requiring or implying any actual such relationship or order between such entities or actions. Numerical ordinals such as "first," "second," "third," etc. simply denote different singles of a plurality and do not imply any order or sequence unless specifically defined by the claim language. The sequence of the text in any of the claims does not imply that process steps must be performed in a temporal or logical order according to such sequence unless it is specifically defined by the language of the claim. The process steps may be interchanged in any order without departing from the scope of the invention as long as such an interchange does not contradict the claim language and is not logically nonsensical.

Furthermore, depending on the context, words such as "connect" or "coupled to" used in describing a relationship between different elements do not imply that a direct physical connection must be made between these elements. For example, two elements may be connected to each other physically, fluidly, electronically, logically, or in any other manner, through one or more additional elements.

Some embodiments may include a motor vehicle 100 as shown in FIG. 1. The vehicle 100 includes an internal combustion engine (ICE) 101. The engine 101 may include one or more features that are common to conventional engines (e.g., diesel engines, a petrol/gasoline engines, etc.). For example, the engine 101 may include an engine block that defines at least one cylinder with a piston moveably disposed therein. The piston may include a linkage with which a crankshaft is turned. A cylinder head may cooperate with the piston to define a combustion chamber.

The vehicle 100 may also include a fuel injection system 150. As shown in FIG. 1, the fuel injection system 150 may be configured for a four-cylinder internal combustion engine 101; however, it will be appreciated that the fuel injection system 150 may be configured for any number of cylinders without departing from the scope of the present disclosure.

The system 150 may include a plurality of fuel injectors, generally indicated at 200. In some embodiments, the plurality of fuel injectors 200 may include a first injector 201, a second injector 202, a third injector 203, and a fourth injector 204.

The plurality of injectors 200 may each be fluidly connected via respective high pressure injection lines 209 to a common rail 206. The common rail 206 may be fluidly attached via a high pressure rail feed line 207 to a high pressure pump 208. The high pressure pump 208 may, in turn, be fluidly connected via a pump feed line 212 to a low pressure pump 205 and a fuel tank 211. The fuel injection system 150 may also include a plurality of return lines 218. In some embodiments, the system 150 may include a first return line 220 and a second return line 222. The first return line 220 may extend from the plurality of fuel injectors 200 to the high pressure pump 208. The second return line 222 may be fluidly connected to the first return line 220 at a fluid junction 224 and may branch therefrom to the tank 211.

The fuel injection system 150 may further include at least one fluid metering valve 216, which is configured to regulate flow from the high pressure pump 208 to the common rail 206. More specifically, the fluid metering valve 216 may have various positions or settings, and the fuel flow from the high pressure pump 208 to the common rail 206 may be controlled according to the current setting of the fluid metering valve 216. Accordingly, the pressure of the fuel within the common rail 206 may be controlled and maintained at one or more predetermined pressures.

The fuel injection system 150 may additionally include a rail pressure sensor 226. The rail pressure sensor 226 may be of a conventional type and may be configured to detect the current pressure in the common rail 206.

The fuel injection system 150 may also include a control system having an Electronic Control Unit (ECU) 210 of the vehicle 100. In other embodiments, the controller may include or incorporate a different or an additional controller. For example, the fuel injection system 150 may be configured to communicate with a hand-held computerized device that may be used by a mechanic or other user (e.g., a portable diagnostics tool, smart phone, tablet, laptop, etc.).

The ECU 210 may receive input signals from various sensors configured to generate control signals in proportion to various physical parameters associated with the engine 101. The sensors may include, but are not limited to, a mass airflow and temperature sensor, a manifold pressure and temperature sensor, a combustion pressure sensor, coolant and oil temperature and level sensors, a fuel rail pressure sensor, a cam position sensor, a crank position sensor, exhaust pressure sensors, an EGR temperature sensor, and an accelerator pedal position sensor. Furthermore, the ECU 210 may generate output signals to various control devices that are arranged to control the operation of the engine 101, including, but not limited to, the fuel injectors 200, the high pressure pump 208, and/or other components. It is noted that dashed lines in FIG. 1 are used to indicate communication between the ECU 210 and the various sensors and devices, but some are omitted for clarity.

The ECU 210 may include a processor 230, which is in communication with a memory element 232 via an interface bus. The processor 230 may be configured to execute instructions stored as a program in the memory element 232 and send and receive signals to/from the interface bus. The memory element 232 may include various storage types including optical storage, magnetic storage, solid state storage, and other non-volatile memory. The interface bus may be configured to send, receive, and modulate analog and/or digital signals to/from the various sensors and control devices. The program may include instruction code embodying the methods disclosed herein, allowing the CPU to carry out such methods and control the engine 101.

The program stored in the memory element 232 may be transmitted from outside via a cable or in a wireless fashion. Outside the fuel injection system 150, the program may be available as a computer program product, which is also called computer readable medium or machine readable medium in the art, and which should be understood to be a computer program code residing on a carrier, said carrier being transitory or non-transitory in nature with the consequence that the computer program product can be regarded to be transitory or non-transitory in nature.

An example of a transitory computer program product is a signal, e.g. an electromagnetic signal, optical signal, etc., which is a transitory carrier for the computer program code. Carrying such computer program code can be achieved by modulating the signal by a conventional modulation technique such as QPSK for digital data, such that binary data representing said computer program code is impressed on the transitory electromagnetic signal. Such signals are e.g. made use of when transmitting computer program code in a wireless fashion via a Wi-Fi connection to a laptop.

In case of a non-transitory computer program product the computer program code is embodied in a tangible storage medium. The storage medium is then the non-transitory carrier mentioned above, such that the computer program code is permanently or non-permanently stored in a retrievable way in or on this storage medium. The storage medium can be of conventional type known in computer technology such as a flash memory, an Asic, a CD or the like.

Instead of an ECU 210, the vehicle 100 may have a different type of processor to provide the electronic logic, e.g. an embedded controller, an onboard computer, or any processing module that might be deployed in the vehicle.

In some embodiments, the ECU 210 may be electrically connected to the high pressure pump 208 for controlling fuel flow from the high pressure pump 208 to the common rail 206. For example, in some embodiments, the ECU 210 may be electrically connected to the fuel metering valve 216. The ECU 210 may be configured to generate and send pump commands to the fuel metering valve 216 to control the setting of the valve 216 and, ultimately to regulate the amount of fuel supplied from the pump 208 to the common rail 206.

The ECU 210 may also be electrically connected to the common rail 206. In some embodiments, the ECU 210 may be in communication with the rail pressure sensor 226. As such, the rail pressure sensor 226 may detect the current pressure within the common rail 206, and the rail pressure sensor 226 may generate and send a corresponding pressure feedback signal to the ECU 210. The rail pressure sensor 226 may continuously detect the rail pressure and provide repeated updates to monitor the current pressure of the rail 206. As will be discussed, the ECU 210 may rely on this signal from the rail pressure sensor 226 as feedback for closed loop control of the fuel metering valve 216 and to maintain a substantially constant pressure at the rail 206.

Furthermore, the ECU 210 may be electrically connected to the fuel injectors 200 for controlling fuel injection into the cylinders of the engine 101. In other words, the ECU 210 may generate and send injection commands to the injectors 200. For example, the injectors 200 may each include an opening that is controlled with a pilot valve inside the injector. The pilot valve may be actuated between an open position and a closed position by a solenoidal actuator or a piezoelectric actuator. The time between the opening command and the closing command is generally referred as energizing time of the fuel injector. The energizing time for the injectors 200 may be determined by the ECU 210 as a function of a desired quantity of fuel to be injected into the respective cylinders of the engine 101. Accordingly, the injectors 200 may be controlled according to the injection commands from the ECU 210, causing a controlled quantity of fuel to be expelled from the injector 200 into the respective combustion chamber.

The fuel injection system 150 may additionally include an output device, such as a display 231. The display 231 may be a computer screen, a dashboard-mounted display, or other display device configured to visually convey information about the fuel injection system 150. It will be appreciated that the system 150 may additionally or alternately include a different type of output device, such as a speaker configured to audibly convey information about the fuel injection system 150 without departing from the scope of the present disclosure.

During normal use of the vehicle 100, the user may notice an anomaly in the functioning of the fuel injection system 150 that is caused by faulty performance of one or more of the fuel injectors 200. The fault may be caused by coking buildup within the injector(s) 200. The fault(s) may cause excessive engine noise and/or poor response to the driver's input. This may lead to drivability problems. For example, the acceleration may have noticeable jumps due to the faulty injector(s) 200. Other problems may arise as well, such as excessive emissions from the engine 101.

Figure 2:
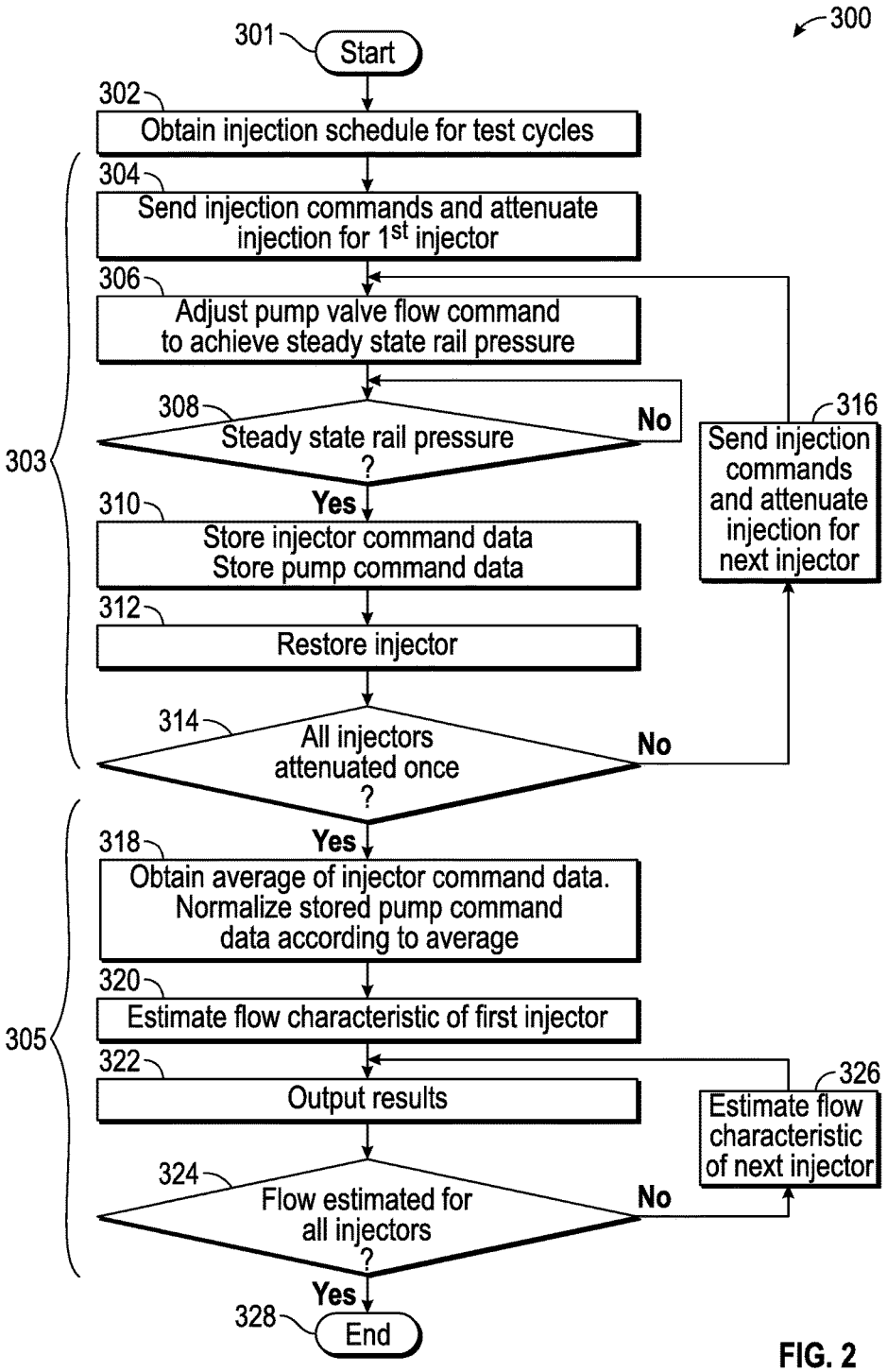
FIG. 2 is a flow chart illustrating a method of evaluating fuel injectors of the fuel injection system of FIG. 1 according to example embodiments.

Accordingly, FIG. 2 illustrates a method 300 for analyzing the fuel injection system 150. In some embodiments, the method 300 may be used to evaluate the performance of the fuel injectors 200. In other words, the method 300 may be used to determine, quantify, or otherwise process the flow characteristics of the fuel injectors 200 and output those flow characteristics to a user. The method 300 may be used to identify one or more faulty injectors 200. The method 300 may also be used to evaluate how much the individual injectors 200 deviate from a predetermined standard. Thus, the flow characteristics and performance of the individual injectors 200 may be estimated accurately. Also, the fuel injection system 150 may be analyzed quickly and accurately using the method 300. Thus, the method 300 may be very convenient and useful.

In some embodiments, the method 300 may be divided into a first data-generating portion 303 and a second data-processing portion 305. Generally, during the first portion 303, the method 300 may include running a plurality of test cycles and gathering data for the respective test cycles. The second portion 305 of the method may include processing data that is gathered during the first portion 303 and outputting test results to the user.

For purposes of simplicity, it will be assumed that the engine 101 is a three cylinder engine and that the first injector 201, the second injector 202, and the third injector 203 are included. (The fourth injector 204 is omitted.) Thus, in some embodiments, the first portion 303 of the method 300 may include three test cycles—one for each of the injectors 201, 202, 203. Also, the second portion 305 of the method 300 may include analysis of all three injectors 201, 202, 203.

The method 300 may begin at 301. It will be appreciated that the method 300 may be initiated manually. For example, the user may enter an input (e.g., by pressing a button, etc.) for starting a computerized program that performs the method 300 for analyzing the performance of the fuel injection system 150. In additional embodiments, the method 300 may be initiated automatically. For example, the ECU 210 may occasionally run the computerized analysis program at predetermined time intervals.

At 302, the ECU 210 may obtain a predetermined, known injection schedule for the injectors 200. The schedule may be a map, a look-up table, or other data file stored in the memory element 232. In some embodiments, the injection schedule may dictate the energizing time (ET) for each injector 200 for achieving predetermined target operating conditions of the engine 101 (e.g., one thousand rev/minute (1000 rpm) at idle). In other words, the injection schedule may dictate the injection request for each injector 200 for achieving the predetermined operating conditions.

Next, at 304 of the method 300, the fuel injection system 150 may begin running a first test cycle, wherein the ECU 210 sends injection commands to the injectors 200 according to the injection schedule obtained at 302. However, during this first test cycle, the ECU 210 may attenuate the injection command for the first injector 201. For example, the ECU 210 may reduce (by a predetermined percentage) the ET of the first injector 201 that is stored in the injection schedule obtained at 302. The injection commands for the other injectors 202, 203 may be unattenuated, meaning that the ET for the second and third injectors 202, 203 may remain as dictated in the injection schedule obtained at 302. In some embodiments of 304 of the method 300, attenuating the fuel request for the first injector 201 may include disabling the first injector 201. In other words, the ECU 210 may reduce the fuel request for the first injector 201 by 100%, thereby effectively disabling the first injector 201. Accordingly, during this first test cycle, the first injector 201 would inject substantially no fuel into the respective combustion chamber, and the other injectors 202, 203 would inject the amount of fuel dictated in the injection schedule obtained at 302. In other embodiments, at 304, the ECU 210 may reduce the ET of the first injector 201 by a predetermined percentage (e.g., by 70%).

Next, at 306, the ECU 210 may generate pump commands for controlling the position of the fuel metering valve 216 of the high pressure pump 208. More specifically, the ECU 210 may command the fuel metering valve 216 to provide enough fuel to maintain a substantially constant pressure at the common rail 206 during this first test cycle. In some embodiments, the ECU 210 may rely on feedback signals from the rail pressure sensor 226 for closed-loop control of the valve 216 and for achieving substantially steady-state pressure at the rail 206. Thus, at 308, the ECU 210 may determine whether the rail pressure has reached a substantially steady state. As shown, the method 300 continues once steady state has been reached.

Once pressure at the common rail 206 has reached steady state, then the method 300 may continue at 310. At 310, the ECU 210 may store injector command data and pump command data in the memory element 232. The injector command data may correspond to the injector commands sent to the injectors 200 during this first test cycle (at 304). The pump command data may correspond to the commands sent to the pump 208 for maintaining the steady state rail pressure (at 306 and 308).

Next, at 312, the ECU 210 may restore full, unattenuated function of the first injector 201. Then, at 314, the ECU 210 may determine whether flow has been attenuated (e.g., disabled) for all of the injectors 200. In this example, only flow for the first injector 201 has been attenuated. Thus, the method 300 may continue to 316.

At 316, a second test cycle may be run, wherein the ECU 210 sends injection commands to the injectors 201, 202, 203, and the injection command for the second injector 202 is attenuated, similar to 304 discussed above. Then, the method 300 may return to 306, and the method 300 may continue as discussed above such that steady state pressure at the rail 206 is achieved (at 308). Then, the injector command data and pump command data may be recorded at 310, and full function of the second injector 202 may be restored at 312. Continuing with the example, the decision block 314 would be answered negatively in this second test cycle. Therefore, the method 300 may return to 316 with unattenuated fuel requests for the first and second injectors 201, 202 and with an attenuated fuel commands for the third injector 203. Again, the method 300 may return to 306 and so on for this third test cycle. Then, at 314, the ECU 210 may determine that a test cycle has been run, wherein the fuel request has been attenuated at least once for each injector 200. As a result, the decision block 314 may be answered affirmatively, and the method 300 may continue at 318.

As an example, the data stored at 310 during the three test cycles may be as follows:

| Test Cycle # | Injector Command ($mm^3$/sec) | Pump Command ($mm^3$/stroke) |
|---|---|---|
| 1 | 7.2 | 355 |
| 2 | 8.8 | 362 |
| 3 | 8.9 | 366 |

Next, at 318, the ECU 210 may calculate an arithmetic mean (i.e., average or simply the mean) of the injector command data. In the above example, the average may be calculated to be 8.3 $mm^3$/sec. Specifically, the ECU 210 may add up all of the injector command data (7.2+8.8+8.9=24.9) and divide by the number of test cycles (24.9÷3=8.3). In other embodiments, instead of the arithmetic mean, at 318 the ECU 210 may determine a reference value for the injector command data that is between the minimum and maximum recorded values (here, a value between 7.2 and 8.9 $mm^3$/sec).

Also, at 318 of the method 300, the ECU 210 may normalize the stored pump command data according to the averaged injector command data. For example, the ECU 210 may calculate the pump command data according to the average by taking a proportion for each test cycle. Using test cycle #1 data from above, the ECU 210 may perform the following calculation (7.2/355=8.3/X) and find that X equals 409. The ECU 210 may perform a similar calculation with data from the other test cycles to obtain a set of normalized pump command data, such as the following:

| Test Cycle # | Avg. Inj. Command ($mm^3$/sec) | Normalized Pump Command ($mm^3$/stroke) |
|---|---|---|
| 1 | 8.3 | 409 |
| 2 | 8.3 | 341 |
| 3 | 8.3 | 341 |

Then, at 320, the ECU 210 may estimate the flow characteristic of the first injector 201 according to programmed logic (e.g., according to one or more equations). The normalized pump command data may be used for this estimation. In some embodiments, the flow characteristic for the first injector 201 may be estimated according to the following equation:

$$F = \frac{T - (C-2)T'}{C-1}$$

In this equation, T is a sum total of the normalized pump commands sent when the first injector 201 was unattenuated (i.e., during the second and third test cycles). Also, C is the total number of combustion chambers of the engine 101. Furthermore, T' is the normalized pump command sent when the first injector 201 was attenuated (i.e., during the first test cycle).

In the above example, the flow characteristic for the first injector 201 may be as follows:

$$F = \frac{(341+341) - (1)409}{2} = 137$$

Furthermore, this value may be converted as follows:

$$137\frac{\text{mm}3}{\text{sec}} \cdot 60\frac{\text{sec}}{\text{min}} \cdot 0.001\frac{\text{min}}{\text{rev}} \cdot \frac{2\,\text{rev}}{3\ \text{stroke}} = 5.5\frac{\text{mm}\ 3}{\text{stroke}}$$

Next, at 322, the ECU 210 may compare this estimated flow characteristic to a predetermined standard and output the comparison (e.g., via the display 231) to inform the user of the flow characteristic estimated at 320. For example, the estimated 5.5 $mm^3$/stroke may be compared to the average 8.3 $mm^3$/stroke calculated at 318 to determine that the first injector 201 is injecting only 66% of the expected amount (i.e., a deviation of approximately 33%). This information may be output in a variety of ways. For example, if the flow characteristics show significant fault (e.g., the estimated flow characteristic deviates from the standard by a predetermined amount) the display 231 may output a report, warning the user to replace the first injector 201. For example, in some embodiments, if deviation is 20% or greater, then the display 231 may output such a warning; therefore, in ongoing example, the display 231 may output the warning to replace the first injector 201.

Subsequently, at 324, the ECU 210 may determine whether flow characteristics have been estimated for all of the injectors 200. Continuing with the example, decision block 324 would be answered negatively since the second and third injectors 202, 203 have not been evaluated. Thus, the method 300 may continue at 326.

At 326, the flow characteristic for the second injector 202 may be calculated. According to the example, the flow characteristic may be calculated as follows:

$$F = \frac{(409+341) - (1)341}{2} = 205$$

Like the above example, this value may be converted such that the estimated flow characteristic for the second injector 202 is approximately 8.2 $mm^3$/stroke. In this example, the second injector 202 is injecting approximately 98% of the expected amount. Accordingly, at 322, the display 231 may output a visual message stating that the second injector 202 is operating satisfactorily.

In this example, at 324, the method 300 may return to 326 and the flow characteristic for the third injector 203 may be estimated as follows:

$$F = \frac{(409 + 341) - (1)341}{2} = 205$$

Like the above example, this value may be converted such that the estimated flow characteristic for the third injector 203 is approximately 8.2 $mm^3$/stroke. In this example, the third injector 203 is injecting approximately 98% of the expected amount. Accordingly, at 322, the display 231 may output a visual message stating that the third injector 203 is operating satisfactorily.

Then, the method 300 may return again to 324. In this example, all of the injectors 200 have been analyzed during this occurrence of 324. Accordingly, the method 300 may terminate at 328.

Accordingly, the method 300 may be employed for evaluating the fuel injectors 200. The analysis may be completed relatively quickly. Also, the results are accurate. Thus, the method 300 may be useful, for example, by an auto mechanic when servicing the vehicle 100.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. A method of analyzing a fuel injection system having a plurality of fuel injectors fluidly connected to a common rail and a pump configured to pump fuel to the common rail, the plurality of fuel injectors including a first fuel injector and at least one other fuel injector, the method comprising:

generating, by a processor, injection commands for the plurality of fuel injectors for a plurality of test cycles according to a predetermined fuel request schedule, including generating injection commands that sequentially attenuate the predetermined fuel request schedule for a different one of the plurality of injectors in the plurality of test cycles, the plurality of test cycles including an attenuated test cycle and at least one unattenuated test cycle, the attenuated test cycle including generating an attenuated injection command for the first fuel injector and generating unattenuated injection commands for the at least one other fuel injector, the at least one unattenuated test cycle including generating an unattenuated injection command for each of the plurality of fuel injectors;

injecting fuel, with the injectors, according to the injection commands to complete the plurality of test cycles;

generating, by the processor, pump commands for the pump to maintain a substantially constant pressure of the common rail during the plurality of test cycles;

storing, in a memory element, first command data for the plurality of test cycles, the first command data corresponding to the injection commands sent during the plurality of test cycles;

storing, in the memory element, second command data for the plurality of test cycles, the second command data corresponding to the pump commands sent during the plurality of test cycles, the second command data having associated pump flow amounts for the plurality of test cycles;

receiving, by the processor from the memory element, the first command data and the second command data; and processing the first command data and the second command data to determine flow characteristics of at least one of the plurality of fuel injectors, including estimating the flow characteristic, F, for the first fuel injector according to:

$$F = \frac{T - (C - 2)T'}{C - 1}$$

wherein T is a sum total of pump flow amounts commanded during the at least one unattenuated test cycle;

wherein C is the total number of combustion chambers; and wherein T' is the pump flow amount commanded during the attenuated test cycle.

2. The method of claim 1, wherein generating injection commands includes sequentially disabling the different one of the plurality of injectors in the plurality of test cycles.

3. The method of claim 1, further comprising generating the pump commands according to a feedback signal sent from a rail pressure sensor to maintain the substantially constant pressure during the plurality of test cycles.

4. The method of claim 1, further comprising:

estimating the flow characteristic, F, for each of the plurality of fuel injectors; and comparing the estimated flow characteristics for the plurality of fuel injectors to a predetermined flow characteristic.

5. The method of claim 4, further comprising determining an arithmetic mean of the estimated flow characteristics for the plurality of fuel injectors;

wherein comparing the estimated flow characteristics includes comparing the estimated flow characteristics to the arithmetic mean; and determining a deviation characteristic of the plurality of injectors.

6. The method of claim 1, wherein processing the first command data and the second command data includes:

determining an arithmetic mean injection quantity request according to the predetermined fuel request schedule;

normalizing the second flow amounts according to the arithmetic mean injection quantity request;

wherein T is a sum total of the normalized pump flow amounts commanded during the plurality of unattenuated test cycles;

wherein C is the total number of combustion chambers; and wherein T' is the normalized pump flow amount commanded during the attenuated test cycle.

7. The method of claim 1, further comprising outputting information related to the determined flow characteristics of the plurality of fuel injectors.

8. The method of claim 7, wherein outputting information comprises visually displaying information related to the determined flow characteristics of the plurality of fuel injectors.

9. An injection system for an engine of a vehicle, the engine including a plurality of combustion chambers, the injection system comprising:

a common rail;

a plurality of fuel injectors fluidly connected to the common rail and configured to inject fuel into a respective one of the plurality of combustion chambers, the plurality of fuel injectors including a first fuel injector and at least one other fuel injector;

a fuel pump configured to pump fuel to the common rail; and a control system in communication with a memory element, the control system configured to:

generate injection commands for the plurality of fuel injectors for a plurality of test cycles according to a predetermined fuel request schedule, including generating injection commands that sequentially attenuate the predetermined fuel request schedule for a different one of the plurality of injectors in the plurality of test cycles, the plurality of test cycles including an attenuated test cycle and at least one unattenuated test cycle, the attenuated test cycle including generating an attenuated injection command for the first fuel injector and generating unattenuated injection commands for the at least one other fuel injector, the at least one unattenuated test cycle including generating an unattenuated injection command for each of the plurality of fuel injectors;

generate pump commands for the pump to maintain a substantially constant pressure of the common rail during the plurality of test cycles;

store, in the memory element, first command data for the plurality of test cycles, the first command data corresponding to the injection commands sent during the plurality of test cycles;

store, in the memory element, second command data for the plurality of test cycles, the second command data corresponding to the pump commands sent during the plurality of test cycles, the second command data having associated pump flow amounts for the plurality of test cycles;

receive, from the memory element, the first command data and the second command data; and process the first command data and the second command data to determine flow characteristics of at least one of the plurality of fuel injectors, including estimating the flow characteristic, F, for the first fuel injector according to:

$$F = \frac{T - (C-2)T'}{C-1}$$

wherein T is a sum total of pump flow amounts commanded during the at least one unattenuated test cycle;

wherein C is the total number of combustion chambers; and wherein T' is the pump flow amount commanded during the attenuated test cycle.

10. The injection system of claim 9, wherein the control system is configured to sequentially disable the different one of the plurality of injectors in the plurality of test cycles.

11. The injection system of claim 9, further comprising a rail pressure sensor configured to detect a current rail pressure and generate a corresponding feedback signal;

wherein the control system is configured to generate the pump commands according to the feedback signal to maintain the substantially constant pressure during the plurality of test cycles.

12. The injection system of claim 9, wherein the control system is configured to estimate the flow characteristic, F, for each of the plurality of fuel injectors; and wherein the control system is configured to compare the estimated flow characteristics for the plurality of fuel injectors to a predetermined flow characteristic.

13. The injection system of claim 12, wherein the control system is configured to determine an arithmetic mean of the estimated flow characteristics for the plurality of fuel injectors;

wherein the control system is configured to compare the estimated flow characteristics to the arithmetic mean; and wherein the control system is configured to determine a deviation characteristic of the plurality of injectors.

14. The injection system of claim 9, wherein the control system is configured to determine an arithmetic mean injection quantity request according to the predetermined fuel request schedule;

wherein the control system is configured to normalize the second flow amounts according to the arithmetic mean injection quantity request;

wherein T is a sum total of the normalized pump flow amounts commanded during the plurality of unattenuated test cycles;

wherein C is the total number of combustion chambers; and wherein T' is the normalized pump flow amount commanded during the attenuated test cycle.

15. The injection system of claim 14, wherein the total number of combustion chambers is at least three.

16. The injection system of claim 9, further comprising an output device configured to output information related to the determined flow characteristics of the plurality of fuel injectors.

17. The injection system of claim 16, wherein the output device comprises a display configured to visually display information related to the determined flow characteristics of the plurality of fuel injectors.

18. A method of analyzing a fuel injection system having a plurality of fuel injectors fluidly connected to a common rail and a pump configured to pump fuel to the common rail, the method comprising:

generating, by a processor, injection commands for the plurality of fuel injectors for a plurality of test cycles according to a predetermined fuel request schedule, including generating injection commands that sequentially disable a different one of the plurality of injectors in the plurality of test cycles;

injecting fuel, with the injectors, according to the injection commands to complete the plurality of test cycles;

generating, by the processor, pump commands for the pump to maintain a substantially constant pressure of the common rail during the plurality of test cycles according to a feedback signal sent from a rail pressure sensor;

storing, in a memory element, first command data for the plurality of test cycles, the first command data corresponding to the injection commands sent during the plurality of test cycles;

storing, in the memory element, second command data for the plurality of test cycles, the second command data corresponding to the pump commands sent during the plurality of test cycles, the second command data having associated pump flow amounts for the plurality of test cycles;

receiving, by the processor from the memory element, the first command data and the second command data; and processing the first command data and the second command data to determine flow characteristics of a first injector of the plurality of fuel injectors, including estimating the flow characteristic, F, for the first injector according to:

$$F = \frac{T - (C - 2)T'}{C - 1}$$

wherein T is a sum total of pump flow amounts commanded during the plurality of test cycles in which the first injector is enabled;

wherein C is the total number of combustion chambers; and wherein T' is the pump flow amount commanded during the plurality of test cycles in which the first injector is disabled.

* * * * *